US006650351B2

(12) United States Patent
Yamamoto et al.

(10) Patent No.: US 6,650,351 B2
(45) Date of Patent: Nov. 18, 2003

(54) INK RIBBON CASSETTE AND THERMAL TRANSFER PRINTER USING THE SAME

(75) Inventors: Toshiyuki Yamamoto, Fukushima-ken (JP); Toshinori Kudo, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/267,975

(22) Filed: Oct. 9, 2002

(65) Prior Publication Data

US 2003/0071887 A1 Apr. 17, 2003

(30) Foreign Application Priority Data

Oct. 11, 2001 (JP) ..... 2001-314240

(51) Int. Cl.[7] ..... B41J 32/00
(52) U.S. Cl. ..... 347/214
(58) Field of Search ..... 347/214, 216; 400/207, 208, 208.1, 247, 248

(56) References Cited

U.S. PATENT DOCUMENTS 6,008,832 A * 12/1999 Sato ..... 347/197
6,307,582 B1 10/2001 Kawato et al.

* cited by examiner

*Primary Examiner*—Huan Tran
(74) *Attorney, Agent, or Firm*—Brinks Hofer Gilson & Lione

(57) ABSTRACT

An apparatus for feeding and discharging of the recording paper printed over the entire page is disclosed. A pair of paper guide members are disposed in the vicinity of the lateral ends of the ink ribbon drawn from the ribbon outlet port respectively so as to project from the wall plate of the cassette body in the direction in which the ink ribbon is drawn. The pair of paper guide members is formed with a surface inclined in such a manner that the projecting length decreases from the projecting top to the base of the paper guide member toward the lateral center of the wall plate.

4 Claims, 10 Drawing Sheets

INK RIBBON CASSETTE AND THERMAL TRANSFER PRINTER USING THE SAME

BACKGROUND OF THE INVENTION

1. Field of the Invention

The present invention relates to an ink ribbon cassette and a thermal transfer printer using the same, and more specifically, to an ink ribbon cassette being capable of feeding and discharging recording papers printed over the entire page properly, and a thermal transfer printer using the same.

2. Description of the Related Art

As shown in FIG. 11, a thermal transfer printer 100 in the related art includes a hollow box-shaped frame 101.

The frame 101 includes a side plate member 101*a* provided on the near side, a side plate member 101*b* provided on the far side opposed to the side plate member 101*a,* a top plate 101*c* provided on top, and a bottom plate 101*d* provided at the bottom.

A cassette mounting portion 102 for mounting an ink ribbon cassette 110 that will be described later is arranged in the hollow portion of the frame 101, and a cassette insertion slot 102*a* is formed on the side plate member 101*a* so as to continue into the cassette mounting portion 102.

Disposed between the side plate members 101*a,* 101*b* of the frame 101 is a rotatable platen roller 104.

At the position opposed to the platen roller 104, there is provided a thermal head 106, which is attached on the head mounting base 107.

The head mounting base 107 is formed into substantially rectangular shape in plan view, and mounted on one of the side plate member 101*b* in a cantilevered manner.

A wall member 113 is disposed in the frame 101 on the left end side, and the wall member 113 is formed with a paper feeding and discharging port 110*a* in communication with the cassette mounting portion 102.

The frame 101 is provided with a paper feed roller 111 in the vicinity of the platen roller 104, and a pressure contact roller 112 being capable of establishing pressure contact with the paper feed roller 111, and being capable of rotating with the paper feed roller 111, so as to be pressure contact therewith.

As shown in FIG. 12 and FIG. 13, the ink ribbon cassette 110 to be attached on and detached from the thermal transfer printer 100 in the related art integrates a cassette body 115 having a substantially elliptical hollow portion for storing an ink ribbon 114, and a ribbon guide member 118 extending from the cassette body 115 on one side.

The cassette body 115 includes a feed core 116 and winding core 117 on which both ends of the ink ribbon 114 are wound stored therein.

As shown in FIG. 12, the cassette body 115 is formed with a slit-shaped ribbon outlet port 115*c* for allowing the ink ribbon 114 wound on the feed core 116 to be drawn out from the cassette body 115.

A triangular paper guide member 115*e* is disposed in the vicinity of the ribbon outlet port 115*c* so as to project from the cassette body 115 in the direction in which the ink ribbon 114 is drawn.

The paper guide members 115*e* are respectively formed at the positions near the widthwise ends of the ink ribbon 114 drawn out from the ribbon outlet port 115*c*.

As shown in FIG. 14, a ribbon sliding wall 118*a* connecting a pair of sidewalls 115*a* of the cassette body 115 are formed under the ribbon guide member 118.

The upper portion of the ribbon sliding wall 118*a* is formed with a ribbon running groove 118*b* of a prescribed clearance.

The ribbon guide member 118 is formed with a ribbon turning-back portion 118*c* at the right end in FIG. 12, and a rotatable roller is disposed at this ribbon turning-back portion 118*c*.

A head mounting base 107 cantilevered by the side plate member 101*b* of the frame 101 may be inserted between the ink ribbon 114 drawn out from the ribbon outlet port 115*c* and the ribbon sliding wall 118*a*.

As shown in FIG. 14, when the ink ribbon cassette 110 is mounted on the cassette mounting portion 102, a clearance 120 is defined between a bottom surface 115*d* of the cassette body 115 and the bottom plate 110*d* of the frame 101, and the clearance 120 continues to the paper feeding and discharging port 110*a,* so that the recording paper 20 to be fed or discharged by the paper feed roller 111 may be carried through the clearance 120 laterally of FIG. 14.

As shown in FIG. 12, the ink ribbon 114 may be drawn out once through the ribbon outlet port 115*c* by the rotation of the winding core 117 in the direction indicated by the arrow E in FIG. 12, passed through under a head insertion portion in the direction indicated by the arrow G, and turned back at the ribbon turning-back portion 118*c*. From this state, the ink ribbon 114 may be traveled over the ribbon sliding wall 118*a* of the ribbon guide member 118, drawn into the cassette body 115 again from the ribbon running groove 118*b,* and then wound on the winding core 117.

As shown in FIG. 16, the recording paper 20 is generally formed of a cut sheet of prescribed dimensions having a leading edge 20*a* and a trailing edge 20*b,* and is formed with a printing area (print-recording surface) 20*c* at the central wide range, and non-printing areas 20*d,* 20*d* at the positions out of the printing area 20*c* near the widthwise ends thereof. The boundary between the leading edge 20*a* and the printing area 20*c* agree with a print starting position 20*s* on the recording paper 20.

When an image is recorded on the recording paper 20 by the thermal transfer printer 100, a desired image is recorded within the printing area 20*c*. When printing the image by full-page printing mode (rimless printing mode) on the recording paper 20, the non-printing areas 20*d,* 20*d* are also included within the printing area.

Referring now to FIG. 14 through FIG. 16, the print-recording operation by the ink ribbon cassette 110 mounted on the thermal transfer printer 100 in the related art will be described.

When the ink ribbon cassette 110 is mounted on the cassette mounting portion 102, the ink ribbon 114 drawn out from the ribbon outlet port 115*c* takes the position between the thermal head 106 and the platen roller 104.

The recording paper 20 inserted from the paper feeding and discharging port 110*a* is carried toward the ribbon turning-back portion 118*c,* and then the platen roller 104 raised toward the thermal head 106 resiliently compresses the thermal head 106 together with the ink ribbon 114. Then a plurality of heating elements selectively heated on the thermal head 106 transfer melted ink on the recording paper 20 to perform a desired printing.

When the desired printing is terminated, the platen roller 104 is lowered to move away from the thermal head 106, and the recording paper 20 is carried outward by the rotation of the paper feed roller 111 and the pressure contact roller 112.

Subsequently, when printing a color image on the recording paper 20, the ink ribbon cassette 110 containing an ink ribbon 114 on which different colors of ink, such as magenta, cyan, yellow, and so on are formed in sequence is used. Then the platen roller 104 is moved up and down repeatedly, and the paper feed roller 111 is repeatedly rotated forwardly and inversely (reversely) for allowing reciprocating motion of the recording paper 20, so that the colors such as magenta, cyan, and yellow are printed superimposingly in sequence at a prescribed position on the recording paper 20 to print a desired color image.

Therefore, the recording paper 20 printed with ink in one color is positioned in such a manner that the trailing edge 20*b* of the recording paper 20 is located between the paper feed roller 111 and the pressure contact roller 112. In this state, the paper feed roller 111 stops rotation (forward rotation) once, then, in order to carry the recording paper 20 in the reverse direction (the direction indicated by the arrow k in FIG. 14), the direction of rotation of the paper feed roller 111 is inversed (reversed) to allow the print starting position 20*s* of the recording paper 20 to locate between the thermal head 106 and the platen roller 104 again. Subsequently, the printing operation as described above is repeated to print with ink of other different colors.

Such thermal transfer printer 100 in the related art is adapted in such a manner that the recording paper 20 can be carried in a state in which the recording paper 20 is kept in sliding contact with the upper surface of the paper guide member 115*e* of the ink ribbon cassette 110 even when the recording paper 20 is carried repeatedly in the directions indicated by the arrows j, k during color printing.

[Problems to be Solved by the Invention]

However, as shown in FIG. 15, when the recording paper 20 printed on its printing surface 20*c* is inversely carried in the direction indicated by the arrow k in FIG. 14, the printing surface 20*c* of the recording paper 20 comes into sliding contact with the upper surface of the paper guide member 115*e* of the cassette body 115. Therefore, in the case where the recording paper 20 is fed in a state of being displaced in the lateral direction, a part of the printing surface 20*c* is rubbed and thus the printing quality may be deteriorated.

In addition, there is such problem that the quality of the image recording is significantly deteriorated when printing over the entire page of the recording paper 20 according to the needs of the user of recent years, because the printing surface 20*c* of the recording paper 20 comes into direct contact with, and thus is rubbed by, the upper surface of the paper guide member 115*e*.

SUMMARY OF THE INVENTION

The invention intends to provide an ink ribbon cassette being capable of feeding and discharging printed recording paper properly without causing deterioration of the quality and a thermal transfer printer using the same.

As a first measure for solving at least one of the problems described above, there is provided an ink ribbon cassette including: a hollow cassette body having a top plate and a bottom plate so as to face toward each other and a wall plate disposed between the top plate and the bottom plate so as to continue into the bottom plate; a feed core and a winding core having an ink ribbon wound thereon and placed in the cassette body; a ribbon outlet port formed on the wall plate for allowing the ink ribbon placed in the cassette body to be drawn out therethrough; the ink ribbon drawn out once from the cassette body through the ribbon outlet port being able to be drawn into the cassette body again and wound on the winding core; a pair of paper guide members disposed in the vicinity of widthwise ends of the ink ribbon drawn through the ribbon outlet port respectively so as to project from the wall plate of the cassette body in the direction in which the ink ribbon is drawn; and at least one of the paper guide members being formed with an inclined surface inclining in such a manner that the projecting length decreases from the projecting top toward the lateral center of the wall plate.

As a second measure, a ribbon guide member extending in one direction from the top plate of the cassette body is provided, and the ink ribbon may be wound in a state of being turned back at the ribbon turning-back portion provided at the distal end of the ribbon guide member.

As a third measure, the wall plate is formed continuously and integrally with an end of the bottom plate and with a connecting portion connecting the top plate and the ribbon guide member respectively, and is inclined gradually toward the ribbon turning-back portion as it extends from one end of the bottom plate toward the top plate.

As a fourth measure, the paper guide members are disposed at the equal distance respectively from the lateral center of the wall plate extending in parallel with the width of the ink ribbon with the inclined surfaces opposing with each other, and is formed into a tapered shape or a curved shape being symmetrical with respect to the center.

BRIEF DESCRIPTION OF THE DRAWINGS

FIG. 10 is a pattern diagram illustrating the relation between the ink ribbon cassette and the recording paper when the ink ribbon cassette according to an embodiment of the invention is mounted on the thermal transfer printer and the action of printing on the recording paper is made, wherein

DESCRIPTION OF THE PREFERRED EMBODIMENTS

Referring now to FIG. 1 through FIG. 10, an ink ribbon cassette according to an embodiment of the invention and a thermal transfer printer using the same will be described.

Figure 1:
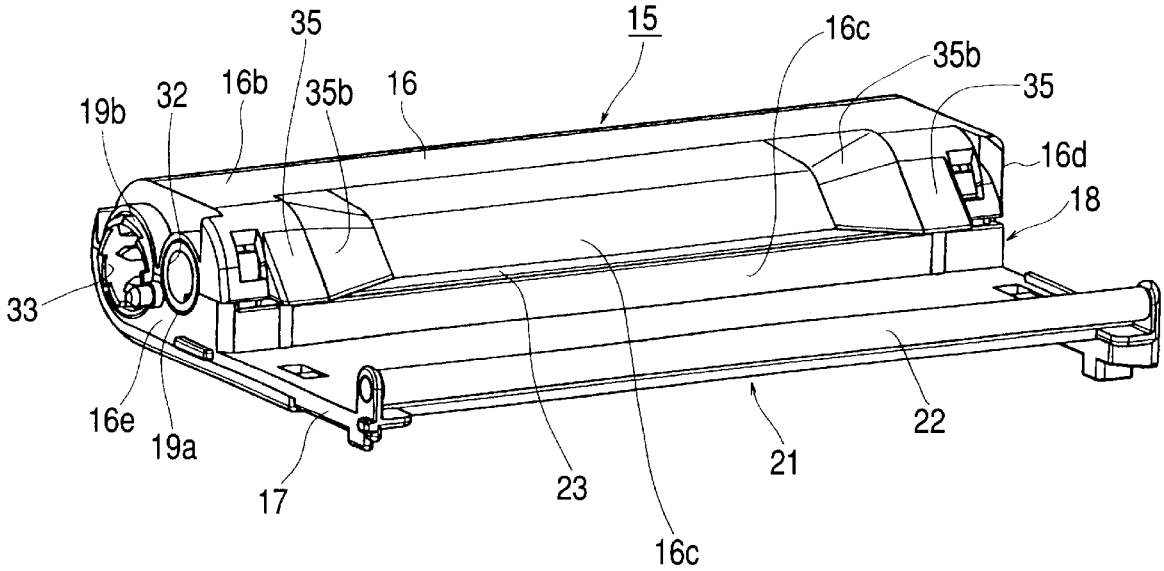
FIG. 1 is a perspective view of the ink ribbon cassette according to an embodiment of the invention.
Figure 2:
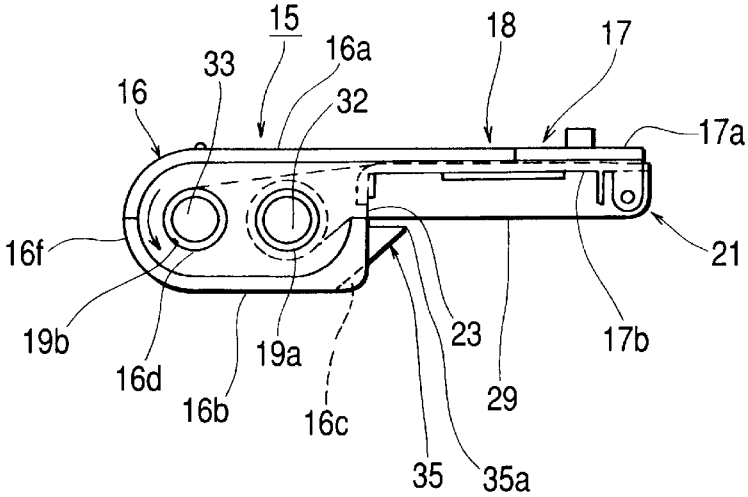
FIG. 2 is a front view of the ink ribbon cassette in FIG. 1.

As shown in FIG. 1 and FIG. 2, an ink ribbon cassette 15 includes a hollow cassette body 16 having a top plate 16*a* and a bottom plate 16*b* opposing with each other and a wall plate 16*c* continuing from the bottom plate 16*b* and disposed between the top plate 16*a* and the bottom plate 16*b*. In addition, a ribbon guide member 17 is extending from the top plate 16*a* of the cassette body 16 in one direction (rightward in FIG. 2).

The cassette body 16 is provided with a pair of substantially elliptical side wall plates 16*d*, 16*e* opposing with each other, and the side wall plates 16*d*, 16*e* are formed respectively with two through holes 19*a*, 19*b* having different diameters. The cassette body 16 is provided with a semi-arcuate outer peripheral wall 16*f* opposing to the wall plate 16*c*.

In this manner, the ink ribbon cassette 15 has a resin cassette case 18 including the cassette body 16 and the ribbon guide member 17 integrally formed with each other.

Figure 3:
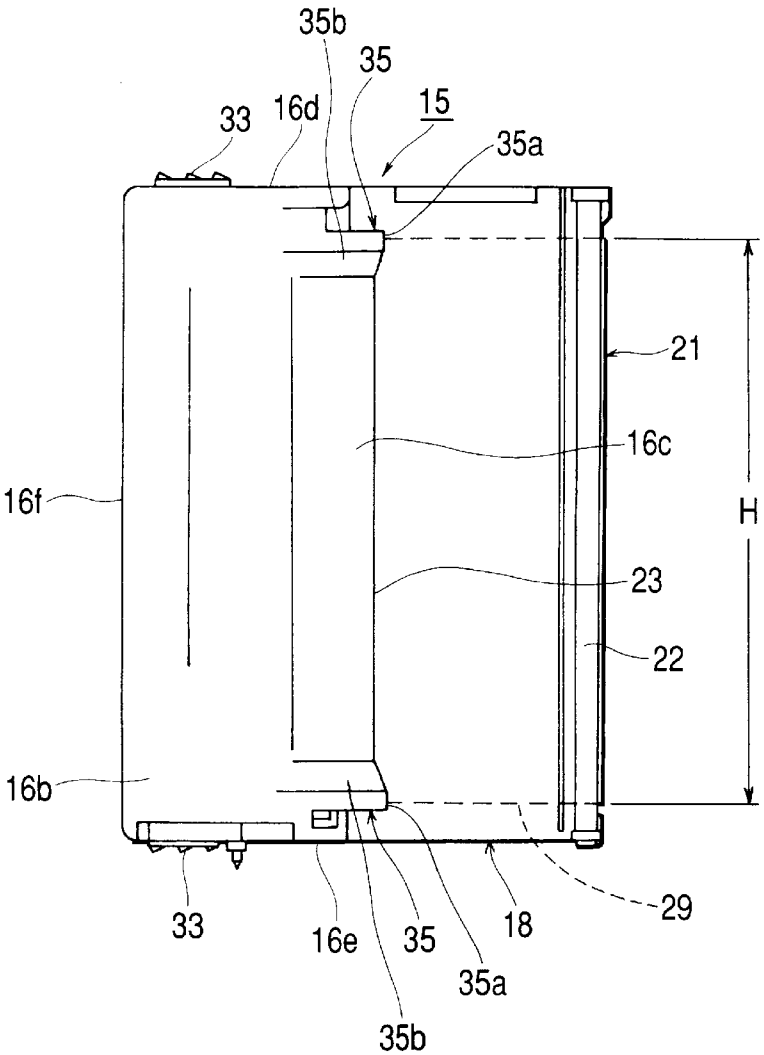
FIG. 3 is a bottom view of the ink ribbon cassette in FIG. 1.

As shown in FIG. 1 and FIG. 3, a ribbon turning-back portion 21 is formed at the distal end of the ribbon guide member 17. A rotatable turning-back roller 22 is disposed at the ribbon turning-back portion 21.

The wall plate 16*c* of the cassette body 16, being formed to have little friction drag on the outer surface thereof, is formed continuously and integrally with an end of the bottom plate 16*b* and with the connecting portion connecting the top plate 16*a* and the ribbon guide member 17, and is formed as an inclined portion inclining gradually toward the ribbon turning-back portion 21 as it extends from one end of the bottom plate 16*b* toward the top plate 16*a*.

The wall plate 16*c* is formed with a slit-shaped ribbon outlet port 23, which is an opening of dimensions that allows an after-mentioned ink ribbon 29 stored in the cassette body 16 to be drawn out therefrom.

Figure 4:
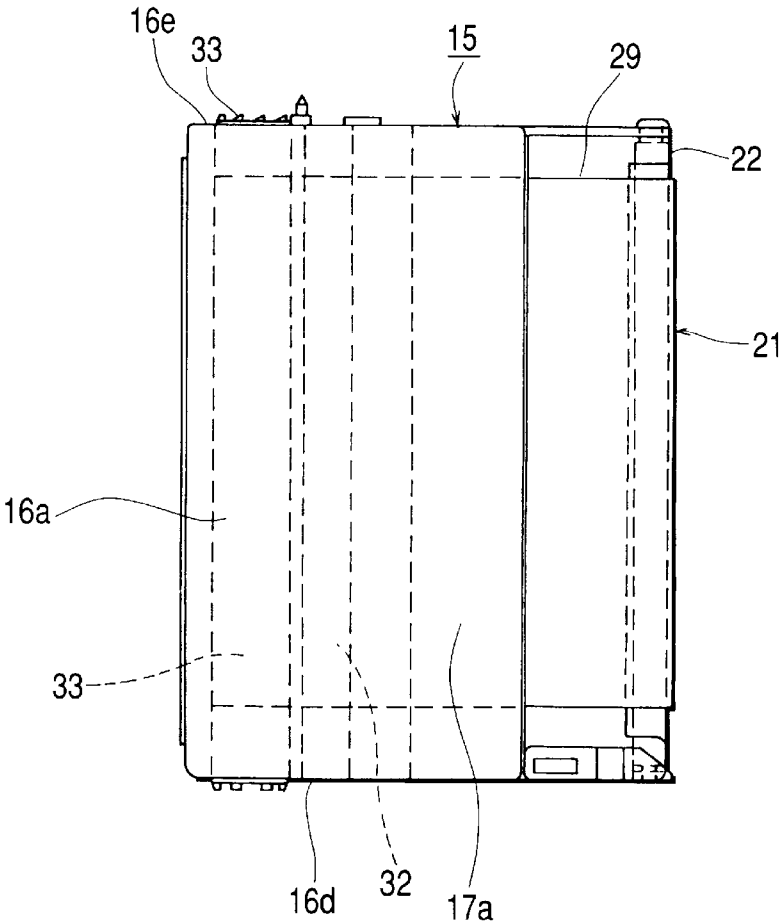
FIG. 4 is a plan view of the ink ribbon cassette in FIG. 1.

As shown in FIG. 4, a cylindrical feed core 32 and a winding core 33 having a wide ink ribbon 29 wound thereon are stored in the hollow portion of the cassette body 16. The feed core 32 and the winding core 33 are disposed between both side wall plates 16*d*, 16*e*, and the both ends of the cores 32, 33 are rotatably supported in the through holes 19*a*, 19*b* respectively (See FIG. 1).

Figure 10A:
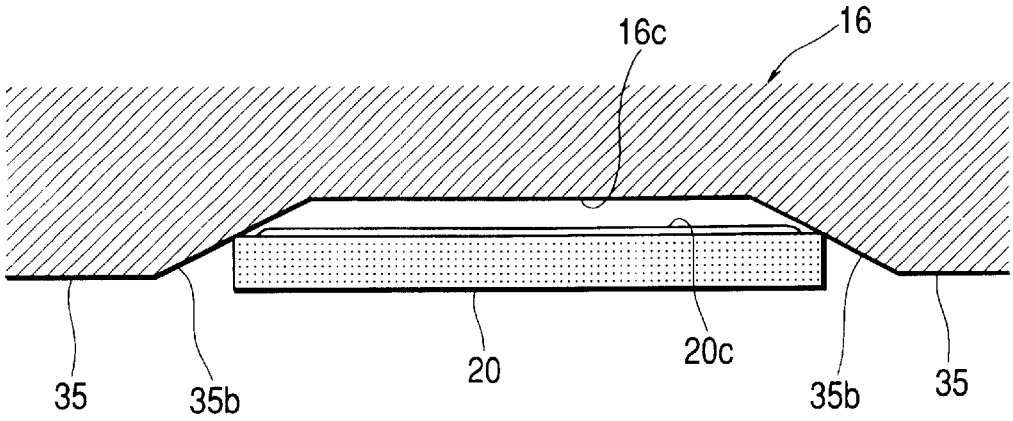
FIG. 10A is a pattern diagram viewed from the side.
Figure 10B:
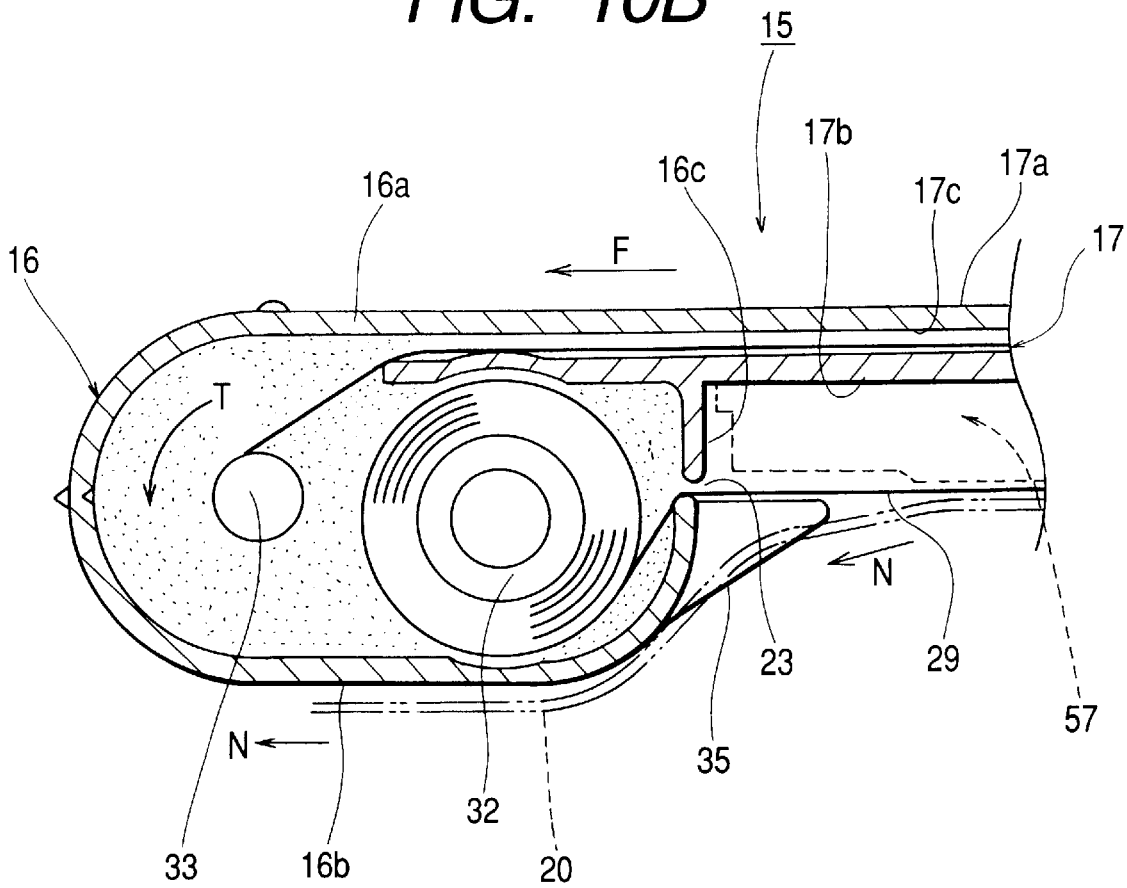
FIG. 10B is a pattern diagram viewed from the front.
Figure 11:
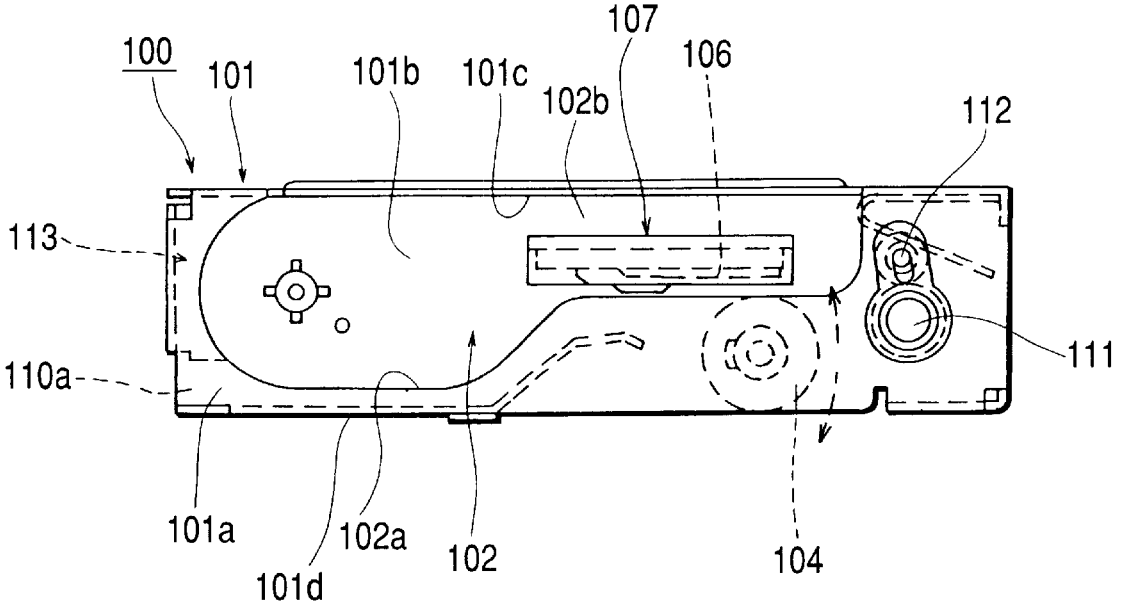
FIG. 11 PRIOR ART
FIG. 11 is a front view of the thermal transfer printer in the related art.
Figure 12:
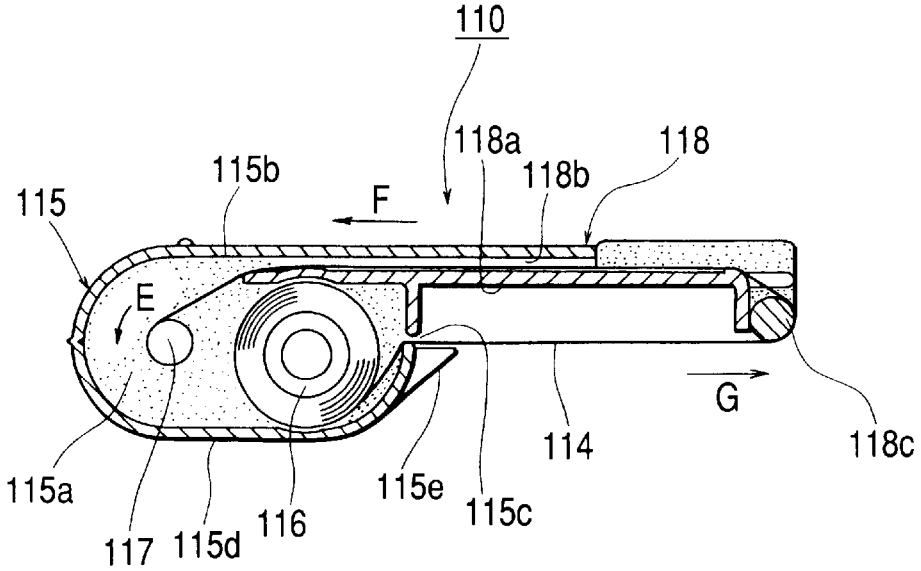
FIG. 12 PRIOR ART
FIG. 12 is a vertical cross section of the ink ribbon cassette that is mountable and dismountable on and from the thermal transfer printer in the related art.
Figure 13:
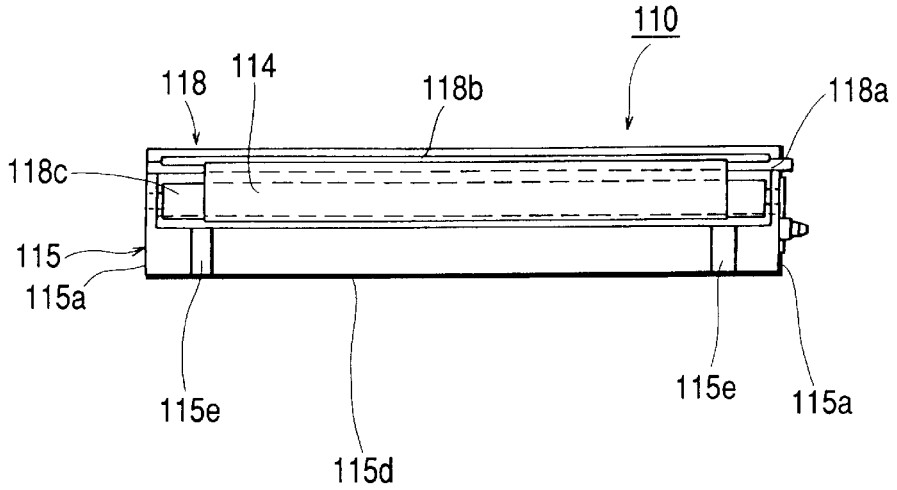
FIG. 13 PRIOR ART
FIG. 13 is a right side view of the ink ribbon cassette shown in FIG. 12.
Figure 14:
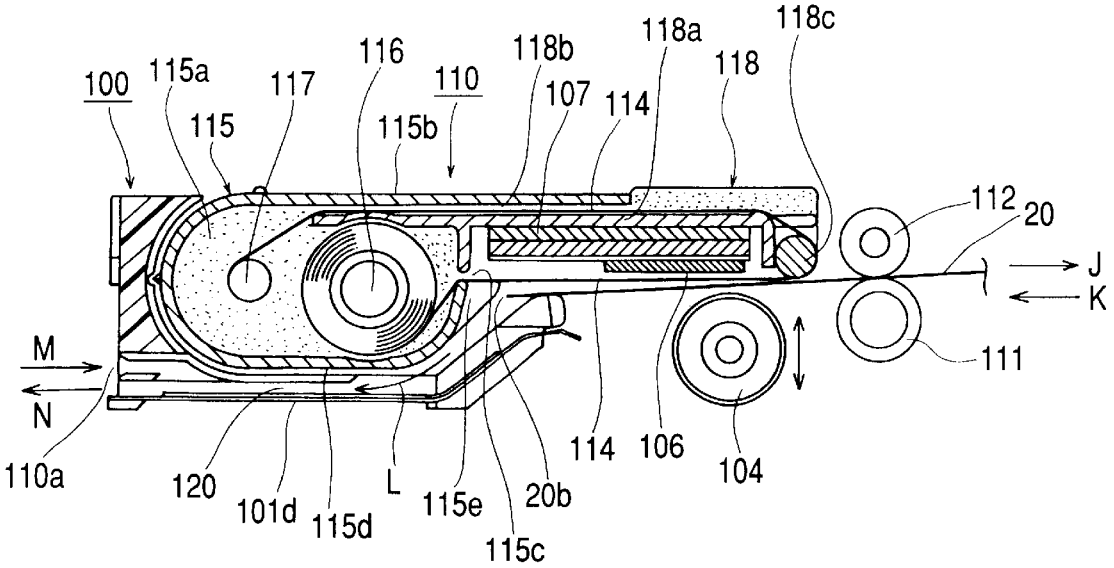
FIG. 14 PRIOR ART
FIG. 14 is a vertical cross sectional view showing a state in which the ink ribbon cassette is mounted on the thermal transfer printer in the related art.
Figure 15:
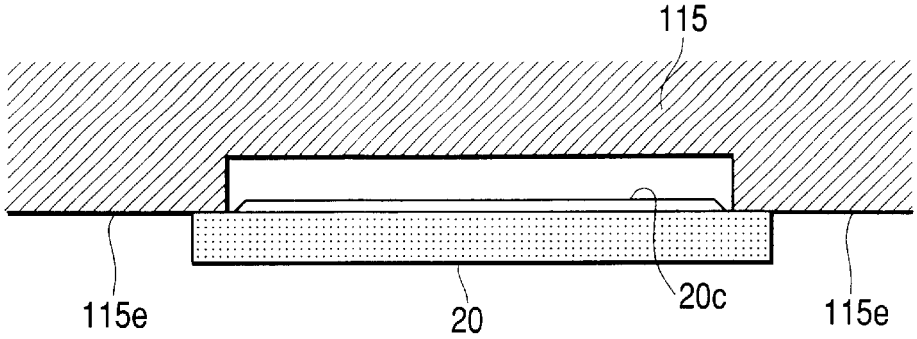
FIG. 15 PRIOR ART
FIG. 15 is a pattern diagram for illustrating the relation between the ink ribbon cassette and the recording paper when the ink ribbon cassette is mounted on the thermal transfer printer in the related art and the action of printing on the recording paper is made.
Figure 16:
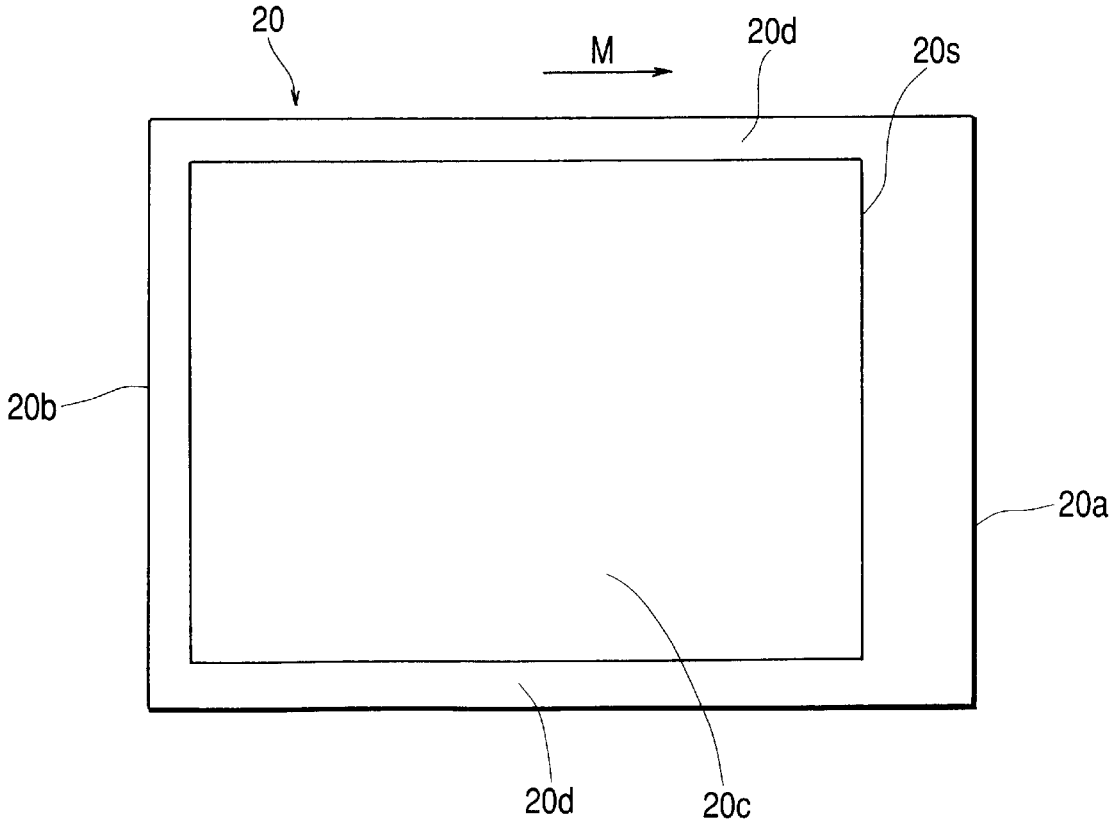
FIG. 16 PRIOR ART
FIG. 16 is a pattern diagram for illustrating the recording paper generally used for the thermal transfer printer.

As shown in FIG. 10B, the ribbon guide member 17 includes an upper plate 17*a* extending from the top plate 16*a* of the cassette body 16 in one direction and being disposed above, and a ribbon sliding wall 17*b* projecting from the wall plate 16*c* of the cassette body 16 and being disposed below, and a ribbon running groove 17*c* is formed in the clearance interposed between the ribbon sliding wall 17*b* and the upper plate 17*a*.

As shown in FIG. 3, a pair of paper guide members 35 are disposed on the wall plate 16*c* of the cassette body 16 in the vicinity of the lateral ends of the ink ribbon 29 drawn from the ribbon outlet port 23 respectively so as to project from the surface of the wall plate 16*c* in the direction in which the ink ribbon 29 is drawn.

An inclined surface 35*b* inclined in such a manner that the projecting length decreases gradually from a projecting top 35*a* toward the lateral center of the wall plate 16*c* is formed on each paper guide member 35 as shown in FIG. 3.

The paper guide members 35 are disposed respectively at the equal distance from the lateral center of the wall plate 16*c* extending in parallel with the width of the ink ribbon 29, and are away from each other by a distance corresponding to the width H of the ink ribbon 29 (See FIG. 3).

The lateral side edges of the recording paper 20 come into sliding contact with the inclined surfaces 35*b* respectively.

The inclined surfaces 35*b* are disposed respectively at the equal distance from the lateral center of the wall plate 16*c* so as to oppose with each other, and are formed into tapered shape symmetrical with respect to the center.

The shape of the inclined surfaces 35*b* is not limited to the tapered shape, but may simply be an asymmetrical or symmetrical curve.

Referring now to FIG. 5 through FIG. 8, a thermal transfer printer 50 using the ink ribbon cassette 15 thus constructed will be described.

Figure 5:
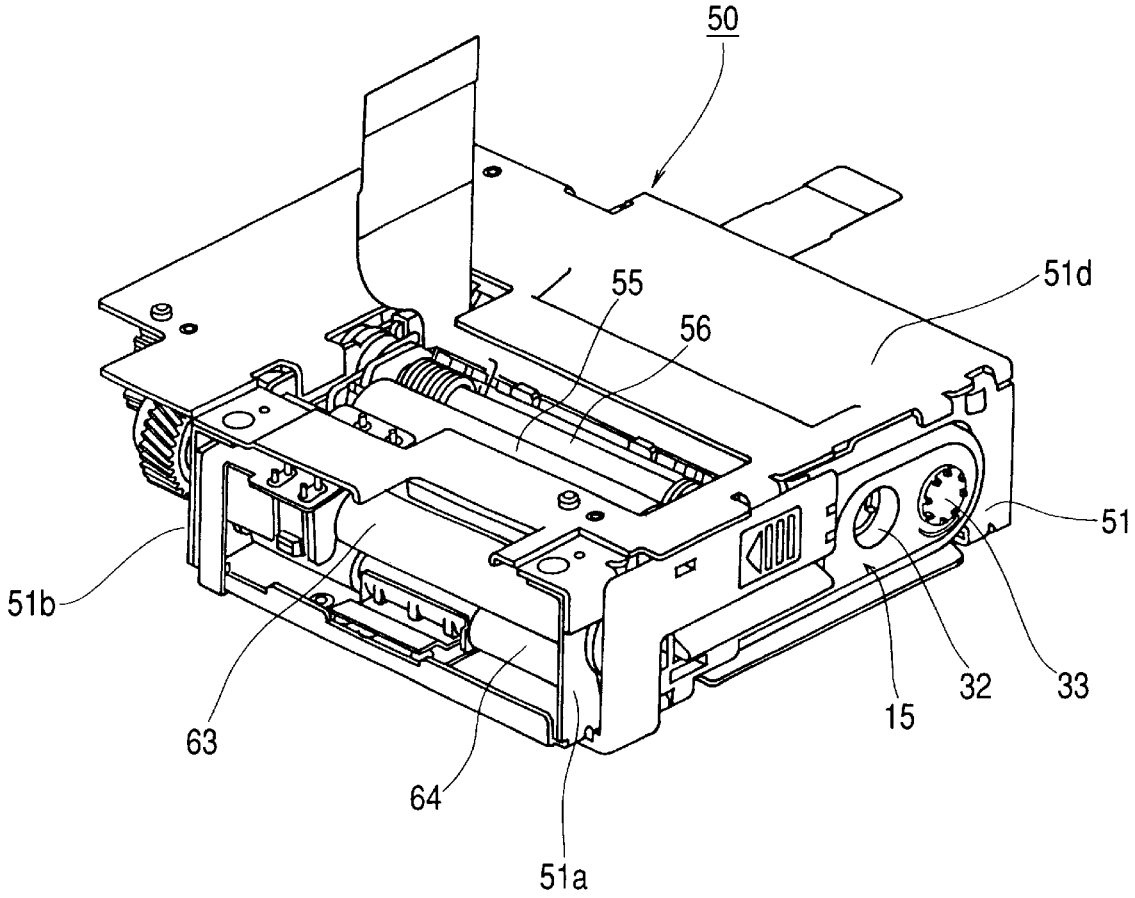
FIG. 5 is a general perspective view of the thermal transfer printer having the ink ribbon cassette according to an embodiment of the invention mounted thereon.
Figure 6:
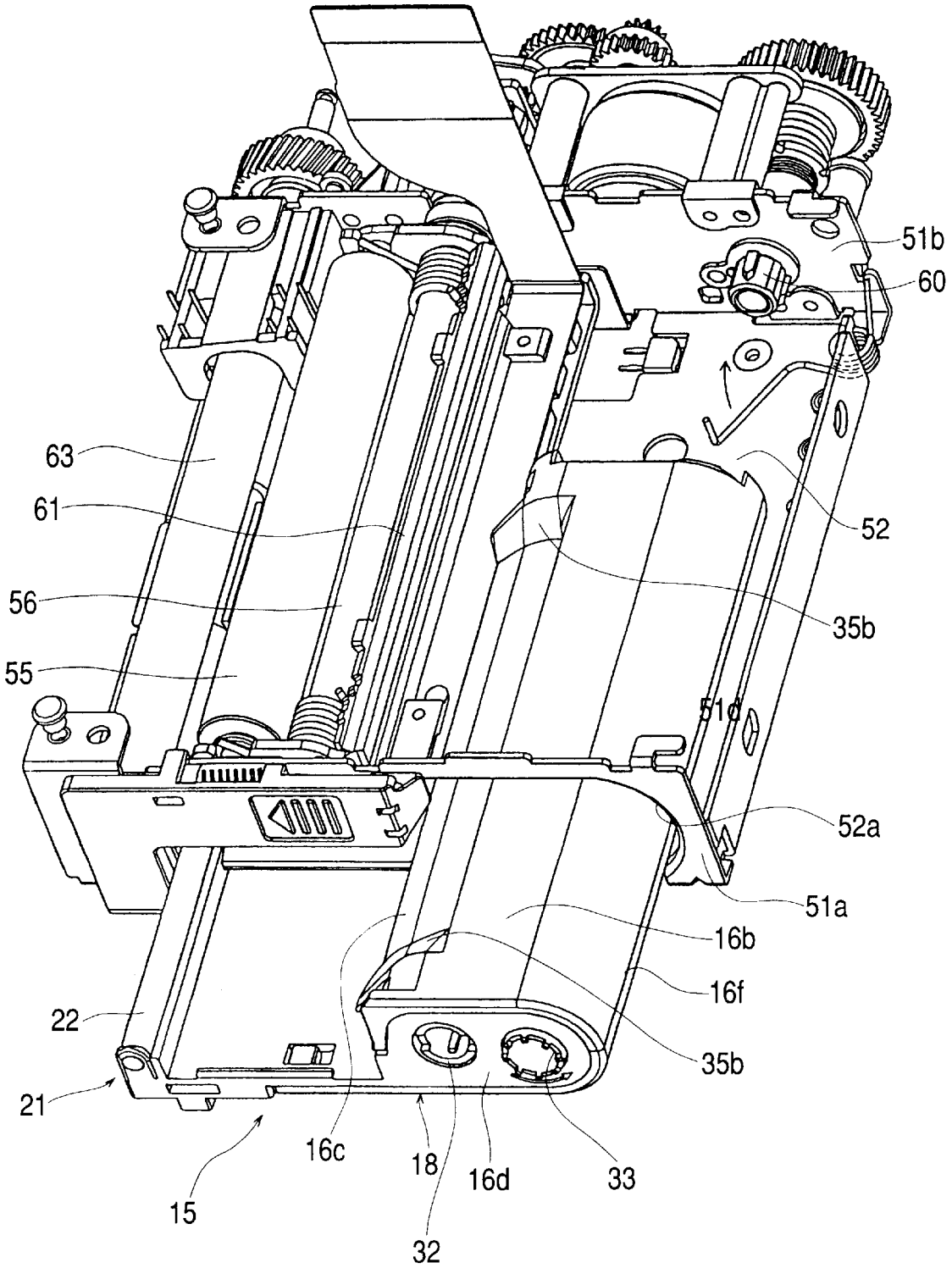
FIG. 6 is a perspective view of the thermal transfer printer according to an embodiment of the invention with the bottom plate removed and viewed from the bottom side.
Figure 7:
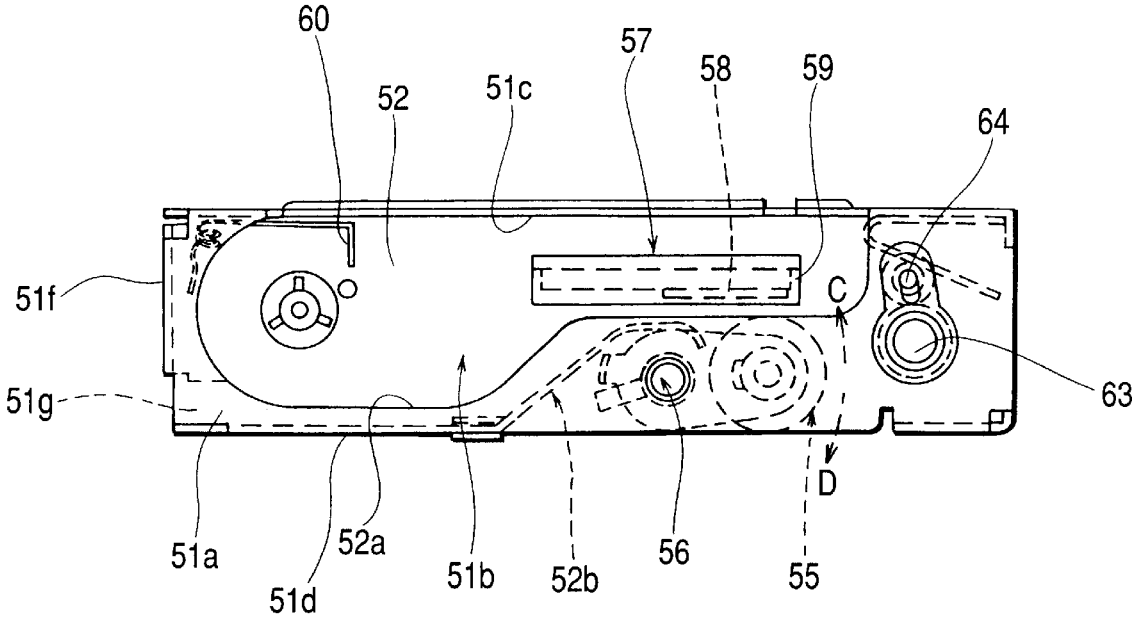
FIG. 7 is a front view of the thermal transfer printer in FIG. 5.

As shown in FIG. 5 and FIG. 6, the thermal transfer printer 50 is hollow box-shape, and includes a metallic frame 51 having a pair of side plate members 51*a*, 51*b* disposed on the near side and the rear side so as to oppose with each other, a top plate 51*c* disposed on the lower side (upper side in FIG. 7), and a bottom plate 51*d* on the upper side (lower side in FIG. 7).

The frame 51 is provided with a cassette mounting portion 52 for mounting the ink ribbon cassette 15 within the hollow portion, and an opening 52*a* for mounting and dismounting the ink ribbon cassette 15 to and from the cassette mounting portion 52 is formed on one of the side plate members 51*a*.

As shown in FIG. 7, a wall member 51*f* is disposed in the frame 51 at the left end, and a paper feeding and discharging port 51*g* continuing to the cassette mounting portion 52 is opened on the wall member 51*f*.

The recording paper 20 may be fed or discharged through the paper feeding and discharging port 51*g*.

As shown in FIG. 6, a shaft member 56 is rotatably supported between the side plate members 51*a*, 51*b* of the frame 51, and a rotatable platen roller 55 is also supported rotatably therebetween in parallel with the shaft member 56 at the ends thereof via a supporting lever 61 having a pair of arms.

A paper feed roller 63 formed of a metal rod and a pressure contact roller 64 (See FIG. 7) whereof the outer periphery which comes in pressure contact with the paper feed roller 63 is formed of resin such as rubber are rotatably mounted between the side plate members 51*a*, 51*b* of the frame 51 on the side (left side in FIG. 6) of the frame 51.

Figure 8:
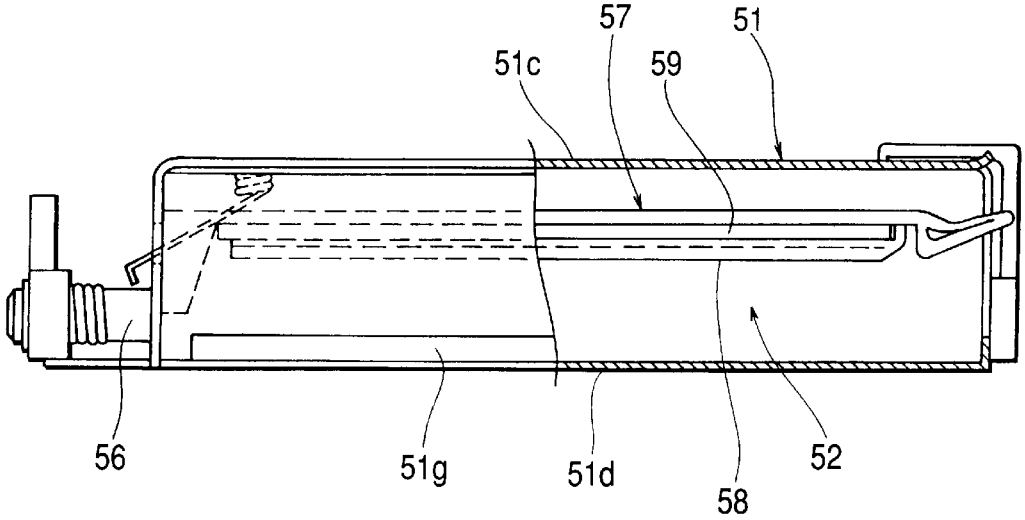
FIG. 8 is a side view of the thermal transfer printer in FIG. 5.

As shown in FIG. 7 and FIG. 8, an inclined base 52*b* formed of resin and having an inclined surface, which is higher on the right side as shown in FIG. 7, is mounted on the bottom plate 51*d* in the cassette mounting portion 52 so as to serve as a lower guide for feeding the recording paper 20 in the lateral direction, especially toward the right in FIG. 7.

A thermal head 57 is disposed in the cassette mounting portion 52.

The thermal head 57 includes a basal plate 58 having a plurality of heating elements, and a head mounting base 59 mounted on the other side plate member 51*b* of the frame 51 for attaching the basal plate 58 thereon. In addition, a rotatable winding bobbin 60 is disposed on the other side plate member 51*b*, so that the winding core 33 of the ink ribbon cassette 15 is fitted thereto.

A series of actions required to mount the ink ribbon cassette 15 on the frame 51 of the thermal transfer printer 50 and carry out printing will now be described referring to FIG. 9, FIG. 10A, and FIG. 10B.

In a first place, when an ink ribbon cassette 15 is inserted on the cassette mounting portion 52 of the thermal transfer printer 50, the thermal head 57 is positioned at the clearance between the ribbon sliding wall 17*b* of the ink ribbon cassette 15 and the exposed ink ribbon 29, and the platen roller 55 is positioned under the thermal head 57.

The ink ribbon 29 drawn from the ribbon outlet port 23 of the cassette body 16 to the ribbon turning-back portion 21 is positioned between the thermal head 57 and the platen roller 55.

Subsequently, when the leading edge 20*a* of the recording paper 20 is inserted through the paper feeding and discharging port 51*g* and carried in the direction indicated by the arrow M in FIG. 9, the leading edge 20*a* is guided on the bottom plate 51*d* of the frame 51, passed between the ink ribbon 29 drawn from the ribbon outlet port 23 and the platen roller 55, and nipped between the paper feed roller 63 and the pressure contact roller 64.

Subsequently, the platen roller 55 is moved upward (in the direction indicated by the arrow E in FIG. 9), and brought into press contact with the thermal head 57 interposing the recording paper 20 and the ink ribbon 29 therebetween, and selectively makes the plurality of heating elements generate heat based on recorded printing information.

Then, the winding core 33 of the ink ribbon cassette 15 is rotated counterclockwise (in the direction indicated by the arrow T in FIG. 9), and the paper feed roller 63 is rotated clockwise, and the recording paper 20 is carried in the direction in which the recording paper 20 is carried (the direction M in the figure) at a prescribed speed.

Simultaneously, melted ink is transferred from the ink ribbon 29 to the recording paper 20, thereby a desired image is printed on the recording paper 20.

Subsequently, in order to discharge the printed recording paper 20 to the side of the paper feeding and discharging port 51*g*, the platen roller 55 is moved away from the thermal head 57 and the state of the recording paper 20 being nipped is released.

Figure 9:
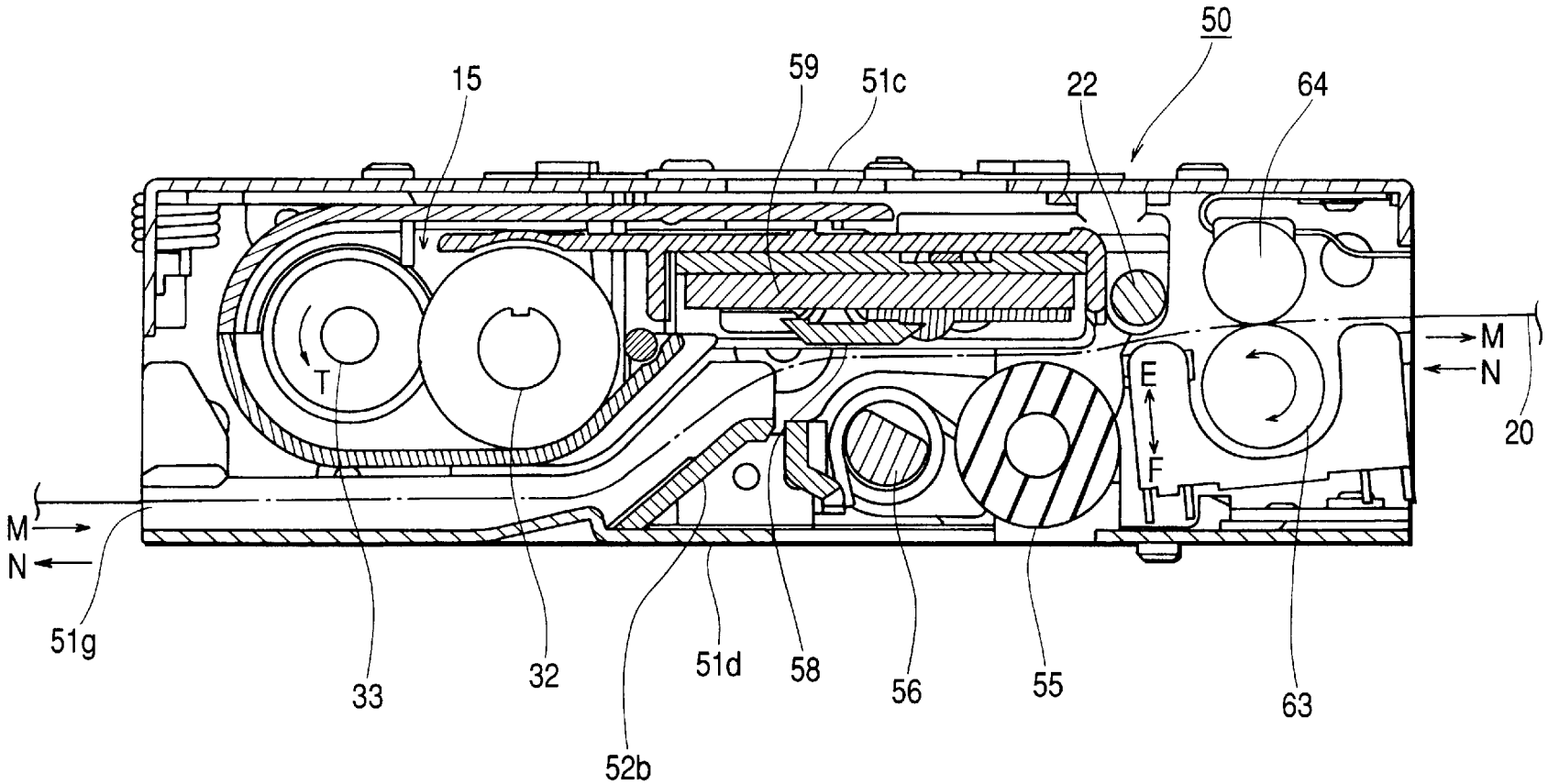
FIG. 9 is a vertical cross sectional view of the thermal transfer printer with the ribbon cassette according to an embodiment of the invention mounted thereon.

Then, the paper feed roller 63 is inversely rotated counterclockwise in FIG. 9, whereby the recording paper 20 is fed (inversely carried) toward the paper feeding and discharging port 51*g* while keeping the side edges 20*d*, 20*d* of the printed recording paper 20 in sliding contact with the inclined surface 35*b* of the paper guide member 35 (See FIG. 10A).

The recording paper 20 is returned toward the bottom plate 16*b* of the cassette body 16 while being guided by each inclined surface 35*b* of the pair of paper guide member 35, and then the trailing edge 20*b* of the recording paper 20 is discharged through the paper feeding and discharging port 51*g* by the counterclockwise rotation of the paper feed roller 63 and the leading edge 20*a* thereof is released from the state of being nipped between the paper feed roller 63 and the pressure contact roller 64.

When printing a color image on the recording paper 20, the ink ribbon 29 formed by applying ink of different colors such as magenta, cyan, yellow and so on in a banding pattern sequentially is used.

A series of the actions required to print a color image are as follows. The platen roller 55 is raised toward the thermal head 57 to nip the ink ribbon 29 and the recording paper 20 with the thermal head 57.

Then, the action of transferring ink on the ink ribbon 29 while carrying the recording paper 20 to the paper feed roller 63 in the direction in which the recording paper 20 is to be carried indicated by the arrow M and the action of moving the platen roller 55 away from the thermal head 57 and rotating the paper feed roller 63 inversely to return the recording paper 20 in the direction indicated by the arrow N are repeated so that ink of a plurality of different colors is printed superimposingly on the recording paper 20 to print a desired color image.

According to the thermal transfer printer 50 of the invention, the recording paper 20 may be carried smoothly at a high degree of positional accuracy while bringing the trailing edge 20*b* or the widthwise side edges thereof after printing into sliding contact with each inclining surface 35*b* of the paper guide member 35 not only in the action of discharging the recording paper 20, but also in the action of reciprocating the recording paper 20 in the directions indicated by the arrows M, N during color printing.

As is described thus far, the ink ribbon cassette 15 of the invention achieves the following effects.

1) A pair of paper guide members 35 are disposed respectively in the vicinity of the lateral ends of the ink ribbon 29 drawn from the ribbon outlet port 23 so as to project from the wall plate 16*c* of the cassette body 16 in the direction in which the ink ribbon 29 is drawn, and a pair of paper guide members 35 are formed with inclined surfaces 35*b* inclined in such a manner that the projecting length decreases from the projecting top 35*a* toward the lateral center of the wall plate 16*c*. Therefore, when the recording paper 20 printed with ink on the ink ribbon 29 is fed, the recording paper 20 is fed properly while bringing the portion of the recording paper 20 where no printing is made, or the side edges of the recording paper 20, into sliding contact with the inclined surface 35*b* of the pair of paper guide members 35. Consequently, the quality of the printed state on the recording paper 20 may be maintained at a high level without causing deterioration of the quality of the printed image. In addition, even when the recording paper 20 is printed over the entire page, the printing surface 20*c* of the recording paper 20 can be prevented from deteriorating and thus the quality may be maintained at a high level, because the recording paper 20 is fed while bringing the lateral side edges into sliding contact with the inclined surface 35*b*.

2) The wall plate 16*c* is formed continuously and integrally with an end of the bottom plate 16*b* and the connecting portion connecting the top plate 16*a* and the ribbon guide member 17 respectively, and is formed so as to incline gradually toward the ribbon turning-back portion 21 as it extends from one end of the bottom plate 16*b* toward the top plate 16*a*. Therefore, even when extremely thin material which is liable to bend is used as the recording paper 20, the recording paper 20 guided and fed to the inclined surface 35*b* may be fed smoothly.

3) The paper guide members 35 are disposed at the equal distance from the lateral center of the wall plate 16*c* extending in parallel with the width of the ink ribbon 29 respectively, and are formed into tapered or curved shape symmetrical with respect to the center with the inclined surfaces 35*b* opposed with each other, and thus the recording paper 20 can be fed properly in the laterally positioned state. Therefore, in the case where ink of difference colors are used for printing on the same area of the recording paper 20 as in color printing, the recording paper 20 may be fed to allow printing with high degree of positional accuracy.

Though an embodiment of the invention has been described thus far, the invention is not limited to the above-described embodiment, and may be modified without departing the scope of the invention.

For example, the ink ribbon cassette may be constructed of a cassette body including a first storage section for storing a rotatable feed core, a second storage section disposed at a distance from the first storage section for storing a rotatable winding core, and a connecting member for connecting side edges of the first and second storage sections. Then a part of the peripheral wall (wall section) of the second storage section may be formed with an opening for feeding the ribbon and a pair of guide sections located in the vicinity of the ends of the opening, and the pair of guide portions may be provided with inclined surfaces respectively.

As is described thus far, since the ink ribbon cassette according to the invention includes a pair of paper guide members disposed in the vicinity of widthwise ends of the ink ribbon drawn through the ribbon outlet port respectively so as to project from the wall plate of the cassette body in the direction in which the ink ribbon is drawn, and at least one of the paper guide members is formed with an inclined surface inclining in such a manner that the projecting length decreases from the projecting top toward the lateral center of the wall plate, when the recording paper printed by the ink ribbon of this ink ribbon cassette is fed, the recording paper can be fed while bringing the portion of the recording paper where no printing is made into sliding contact with the inclined surface of the paper guide member. Therefore, the quality of printing image on the recording paper may be maintained at a high level without causing deterioration of the printed image. Such effect is significant especially when the recording paper is printed over the entire page.

What is claimed is:

1. An ink ribbon cassette comprising:

a hollow cassette body including a top plate and a bottom plate facing each other and a wall plate disposed between the top plate and the bottom plate so as to be continued from the bottom plate;

a feed core and a winding core having an ink ribbon wound thereon and placed in said cassette body;

a ribbon outlet port formed on said wall plate for allowing said ink ribbon placed in the cassette body to be drawn out therethrough;

said ink ribbon drawn out once from the cassette body through said ribbon outlet port being able to be drawn into the cassette body again and wound on said winding core;

a pair of paper guide members disposed in a vicinity of widthwise ends of said ink ribbon drawn through said ribbon outlet port respectively so as to project from said wall plate of said cassette body in a direction in which said ink ribbon is drawn; and at least one of the paper guide members being formed with an inclined surface inclining such that a projecting length decreases from a projecting top toward a lateral center of said wall plate.

2. An ink ribbon cassette according to claim 1, wherein a ribbon guide member extending in one direction from said top plate of the cassette body is provided, and said ink ribbon may be wound in a state of being turned back at a ribbon turning-back portion provided at a distal end of the ribbon guide member.

3. An ink ribbon cassette according to claim 2, wherein said wall plate is formed continuously and integrally with an end of said bottom plate and with a connecting portion connecting said top plate and said ribbon guide member respectively, and is inclined gradually toward said ribbon turning-back portion as said wall plate extends from one end of said bottom plate toward said top plate.

4. An ink ribbon cassette according to claim 1, wherein said paper guide members are disposed at equal distances from the lateral center of the wall plate extending in parallel respectively with a width of said ink ribbon with inclined surfaces opposing with each other, and is formed into one of a tapered shape and a curved shape being symmetrical with respect to said center.

* * * * *